US005365670A

United States Patent [19]

Klimochko

[11] Patent Number: 5,365,670

[45] Date of Patent: Nov. 22, 1994

[54] HUNTING SCOPE ENHANCED MAGNIFICATION LENS ACCESSORY

[76] Inventor: Vernon W. Klimochko, General Delivery, Binscarth, Manitoba, Canada, R0J 0G0

[21] Appl. No.: 202,663

[22] Filed: Feb. 25, 1994

Related U.S. Application Data

[63] Continuation of Ser. No. 84,921, Jul. 1, 1993.

[51] Int. Cl.[5] ..... F41G 1/38

[52] U.S. Cl. ..... 33/245; 42/90; 33/233; 33/244

[58] Field of Search ..... 33/233, 244, 245, 247, 33/249, 250, 252, 253, 260, 261; 42/90, 100; 359/813

[56] References Cited

U.S. PATENT DOCUMENTS

| | | | |
|---|---|---|---|
| 151,746 | 6/1874 | Bausch | 359/813 |
| 358,747 | 3/1887 | Orr et al. | 33/260 |
| 761,390 | 5/1904 | Nehring | 359/813 |
| 772,471 | 10/1904 | Nehring | 359/813 |
| 1,903,326 | 4/1933 | Crawley | 33/253 |
| 2,437,363 | 3/1948 | Smith | 33/253 |
| 2,488,188 | 11/1949 | Halvorson | 33/244 |
| 2,657,465 | 11/1953 | Lloyd | 33/244 |
| 2,738,585 | 3/1956 | Vissing | 33/244 |
| 2,782,510 | 2/1957 | Kramm | 33/244 |
| 3,131,477 | 5/1964 | Thomas | 33/244 |
| 3,260,008 | 7/1966 | Yeomans, Jr. | 33/233 |
| 3,492,733 | 2/1970 | Leatherwood | 33/245 |
| 4,247,161 | 1/1981 | Unertl, Jr. | 33/246 |
| 5,003,697 | 4/1991 | Hampton | 33/244 |

*Primary Examiner*—William A. Cuchlinski, Jr.
*Assistant Examiner*—G. Bradley Bennett
*Attorney, Agent, or Firm*—John R. Flanagan

[57] ABSTRACT

A lens structure is arranged for mounting to a forward end of a hunting scope to provide for enhanced magnification of the hunting scope in use.

18 Claims, 2 Drawing Sheets

HUNTING SCOPE ENHANCED MAGNIFICATION LENS ACCESSORY

This application is a continuation of application Ser. No. 08/084,921, filed Jul. 1, 1993.

BACKGROUND OF THE INVENTION

1. Field of the Invention

The field of invention relates to hunting scope apparatus, and more particularly pertains to a new and improved hunting scope adjunct lens apparatus permitting the mounting of accessory magnification lens structure relative to a hunting scope.

2. Description of the Prior Art

Hunting scopes of various types are indicated in the prior art such as exemplified by the U.S. Pat. Nos. 3,861,803; 3,492,733; and 4,982,502.

The instant invention attempts to overcome deficiencies of the prior art by providing for an individual to mount an accessory magnification lens without the need for purchasing of complete hunting scope units and in this respect, the present invention substantially fulfills this need.

SUMMARY OF THE INVENTION

In view of the foregoing disadvantages inherent in the known types of hunting scope apparatus now present in the prior art, the present invention provides a hunting scope adjunct lens apparatus wherein the same is arranged for the accessory mounting of a magnification lens relative to a hunting scope. As such, the general purpose of the present invention, which will be described subsequently in greater detail, is to provide a new and improved hunting scope adjunct lens apparatus which has all the advantages of the prior art hunting scope apparatus and none of the disadvantages.

To attain this, the present invention provides a lens structure arranged for mounting to a forward end of a hunting scope to provide for enhanced magnification of the hunting scope in use.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved hunting scope adjunct lens apparatus which has all the advantages of the prior art hunting scope apparatus and none of the disadvantages.

It is another object of the present invention to provide a new and improved hunting scope adjunct lens apparatus which may be easily and efficiently manufactured and marketed.

It is a further object of the present invention to provide a new and improved hunting scope adjunct lens apparatus which is of a durable and reliable construction.

An even further object of the present invention is to provide a new and improved hunting scope adjunct lens apparatus which is susceptible of a low cost of manufacture with regard to both materials and labor, and which accordingly is then susceptible of low prices of sale to the consuming public, thereby making such hunting scope adjunct lens apparatus economically available to the buying public.

Still yet another object of the present invention is to provide a new and improved hunting scope adjunct lens apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
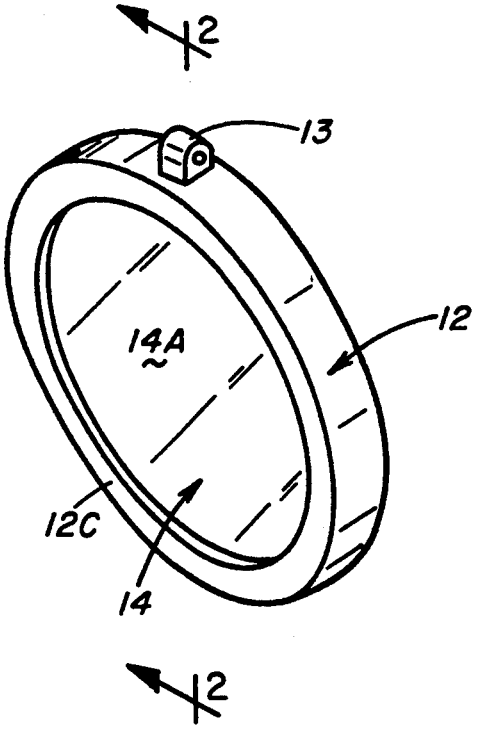
FIG. 1 is an isometric illustration of the accessory lens housing ring of the invention.
Figure 2:
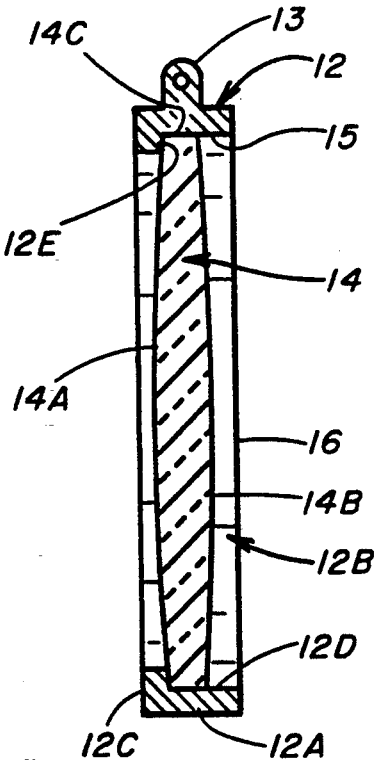
FIG. 2 is an orthographic view, taken along the lines 2—2 of FIG. 1 in the direction indicated by the arrows.
Figure 3:
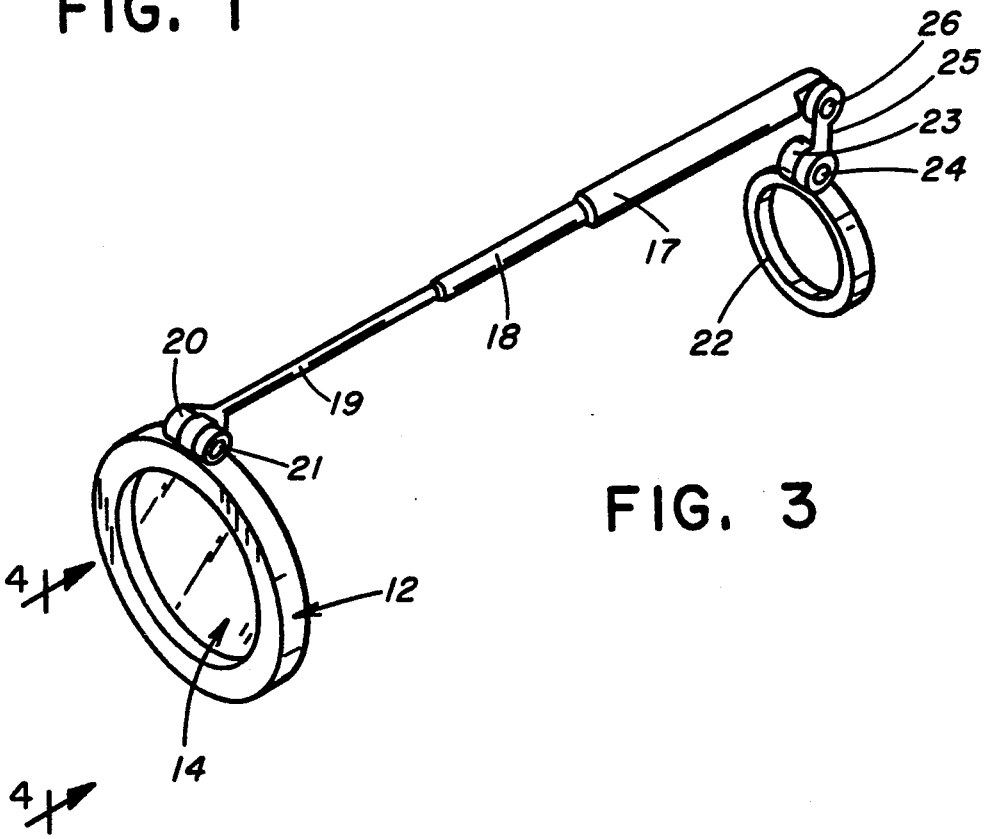
FIG. 3 is an isometric illustration of the invention arranged for clamping to a hunting scope.

With reference now to the drawings, and in particular to FIGS. 1 to 6 thereof, a new and improved hunting scope adjunct lens apparatus embodying the principles and concepts of the present invention and generally designated by the reference numeral 10 will be described.

More specifically, the hunting scope adjunct lens apparatus 10 of the instant invention essentially comprises mounting to a hunting scope 11 that is of itself of conventional construction of a type as exemplified and indicated in the U.S. Pat. No. 3,492,733 incorporated herein by reference.

Briefly, the hunting scope 11 includes an elongated tubular housing 11A having opposite front and rear ends (only the front end 11B being shown) and optical means contained in the tubular housing 11A for producing a first predetermined magnification of an object viewed through the optical means. As is well-known in the art and disclosed in aforementioned U.S. Pat. No. 3,492,733, the optical means includes an objective 11C disposed at the front end 11B of the housing 11A and an eyepiece (not shown) disposed at the rear end (not shown) of the housing 11A.

Figure 6:
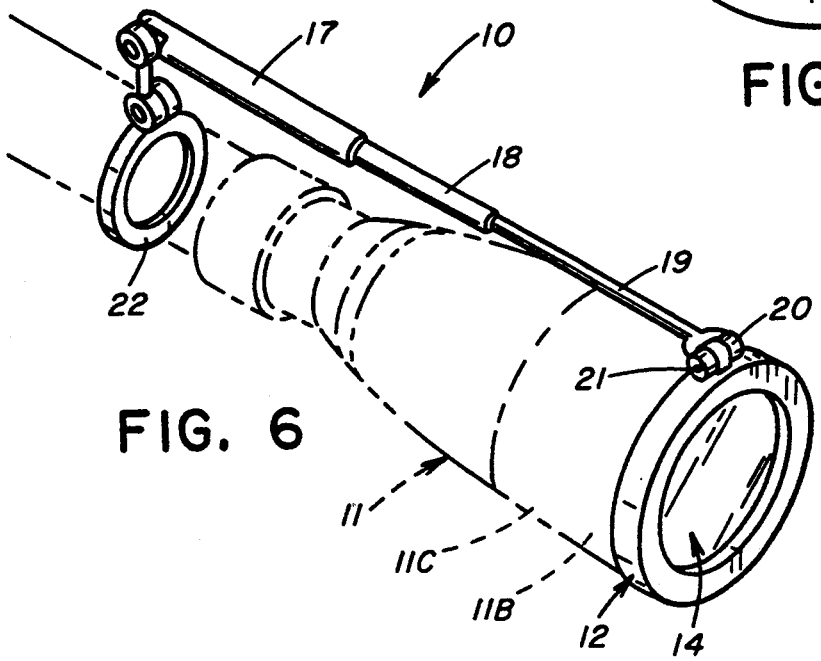
FIG. 6 is an isometric illustration of the invention in an assembled configuration relative to a hunting scope.

A cylindrical housing ring 12 is provided, having a support boss 13 positioned radially and exteriorly of the housing ring 12. A lens 14 is arranged and mounted within the housing ring 12 in a concentric relationship, wherein the lens 14 is of a typical magnification lens construction of any desired magnification as required. A scope securement skirt 15 extends from the lens 14 to the ring entrance 16, with the housing ring 12 formed of a resilient material arranged to permit resilient engaging of the forward end of a hunting scope received within the securement skirt 15, in a manner as indicated in FIG. 6.

More particularly, the housing ring 12 of the hunting scope adjunct lens apparatus or magnification lens accessory 10 has an annular body 12A defining a central opening 12B through the ring 12 and a front annular lip 12C defined on the annular body 12A at a front end of the ring 12 and projecting radially inwardly from the annular body 12A. The annular body 12A has an internal annular surface 12D thereon extending from the annular lip 12A to a rear end of the ring 12. The internal annular surface 12D has an internal diameter greater than the internal diameter of the annular lip 12C such that an annular radial shoulder 12E is formed by a rearward end of the annular lip 12C which is disposed adjacent to a forward end of the annular surface 12D and faces toward the rear end of the ring 12.

The magnifying lens 14 has opposite front and rear faces 14A, 14B and is received across the central opening 12B through the housing ring 12. The magnifying lens 14 has an outer annular edge 14C extending between the faces 14A, 14B which is mounted in a tight fitting relationship within the internal annular surface 12D on the annular body 12A thereof. Preferably, the magnifying lens 14 is disposed adjacent to the front annular lip 12C on the annular body 12A with the front face 14A of the magnifying lens 14 in abutting relation with the annular radial shoulder 12E and the rear face 14B of the magnifying lens 14 spaced from the rear end of the housing ring 12 so as to define the securement skirt 15 on the housing ring 12 adapting the ring 12 to removably fit and mount over the front end 11B of the tubular housing 11A of the hunting scope 11. The magnifying lens 14 of the accessory 10 is constructed to produce a second predetermined magnification of an object viewed through the magnifying lens 14 such that when the accessory 10 is applied to the hunting scope 11, the second predetermined magnification of the magnifying lens 14 will combine with the first predetermined magnification of the optical means of the hunting scope 11 to thereby increase and enhance the overall magnification of a distant object viewed through the hunting scope 11.

Additionally to secure the housing ring, a support tube 17 is provided having respective first and second telescoping legs 18 and 19 respectively extending from the support tube and the first telescoping leg respectively, such that the second telescoping leg 19 terminates in a bifurcated mount 20 having a first axle 21 pivotally mounting the bifurcated mount 20 to the support boss 13. A resilient split clamp ring 22 is arranged for securement about the body of the scope 11, wherein the clamp ring 22 includes a clamp ring boss 23, wherein a second axle 24 pivotally mounts a connecting rod 25 to the clamp ring boss 23. The connecting rod 25 is mounted to the support tube 17 about a third axle 26.

Figure 5:
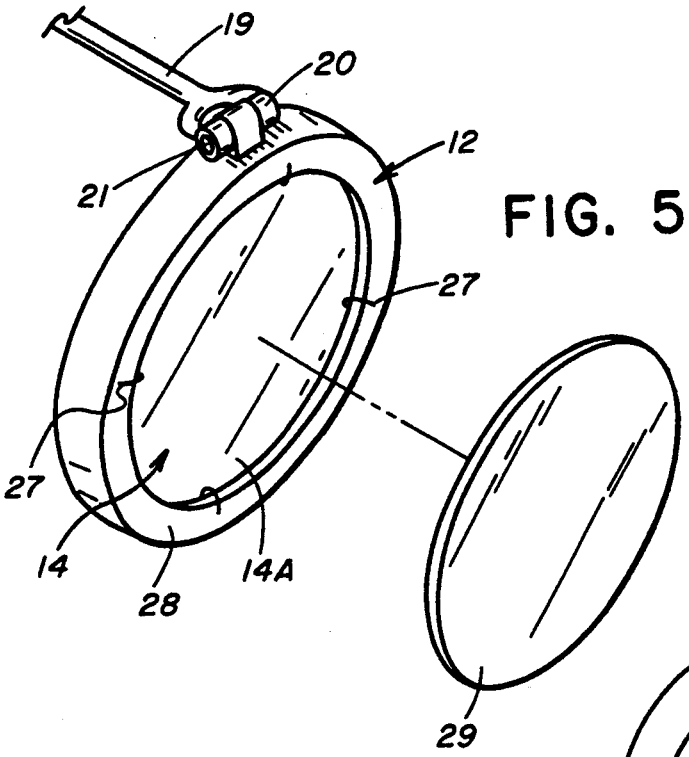
FIG. 5 is an isometric illustration of the invention arranged to further permit mounting of a light filtration lens relative to the magnification lens.
Figure 4:
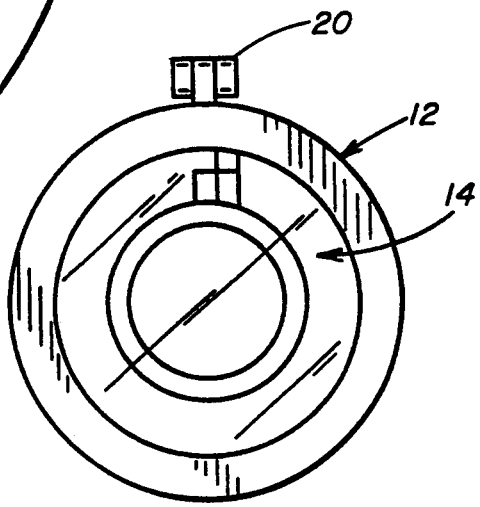
FIG. 4 is an orthographic view, taken along the lines 4—4 of FIG. 3 in the direction indicated by the arrows.

The FIGS. 5 and 6 indicate the use of a plurality of spring clips 27 radially oriented about the housing ring front wall 28 of the housing ring 12 arranged to secure accessory light filter lens 29 between the spring clips 27 and the lens 14 upon lifting of the spring clips 27 permitting the filter lens 29 to interfit between the spring clips 27 and the lens 14.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A magnification lens accessory for enhancing magnification of a hunting scope including an elongated tubular housing having a front end and optical means contained in the tubular housing for producing a first predetermined magnification of an object viewed through the optical means, said accessory accessory comprising:

(a) a magnifying lens adapted to produce a second predetermined magnification of an object viewed through said magnifying lens; and (b) an annular mounting member having a central opening receiving said magnifying lens and an annular skirt extending away from said magnifying lens so as to adapt said annular mounting member to removably fit and mount over the front end of the tubular housing of the hunting scope such that said second predetermined magnification of said magnifying lens will combine with the first predetermined magnification of the optical means of the hunting scope to thereby increase and enhance the overall magnification of an object viewed through the hunting scope.

2. The accessory of claim 1 wherein said annular mounting member is a housing ring having an annular body defining said central opening through said housing ring and a front annular lip defined on said annular body at a front end of said housing ring and projecting radially inwardly from said annular body.

3. The accessory of claim 2 wherein said magnifying lens is disposed within said opening and adjacent to said front annular lip on said annular body and spaced from a rear end of said housing ring so as to adapt said housing ring at a rear skirt portion thereof to removably fit and mount over the front end of the tubular housing of the hunting scope.

4. The accessory of claim 3 wherein said annular body has an internal annular surface thereon extending from said annular lip to said rear end of said housing ring, said internal annular surface having an internal diameter greater than an internal diameter of said annular lip such that an annular shoulder is formed by a rearward end of said annular lip disposed adjacent to a forward end of said annular surface.

5. The accessory of claim 4 wherein said magnifying lens has opposite front and rear faces and an outer annular edge extending therebetween, said magnifying lens being disposed adjacent to said front annular lip on said annular body with said front face to said magnifying lens in abutting relation with said annular shoulder and said rear face of said magnifying lens spaced from said rear end of said housing ring so as to adapt said housing ring to removably fit and mount over the front end of the tubular housing of the hunting scope.

6. The accessory of claim 1 further comprising:

a mounting bracket having rearward means for mounting to a portion of the tubular housing of the hunting scope spaced remote from the front end thereof, forward means for connecting with said annular mounting member and elongated means for extending between and interconnecting said rearward mounting means and forward connecting means so as to permit said annular mounting member and said magnifying lens supported therein to be movable toward and away from the front end of the tubular housing of the hunting scope.

7. The accessory of claim 6 wherein said rearward mounting means is a resilient split clamp ring adapted for securely fitting about the portion of the tubular housing of the hunting scope.

8. The accessory of claim 7 wherein said forward connecting means is a pivotal hinge connected between said elongated interconnecting means and said annular mounting member.

9. The accessory of claim 8 wherein said elongated interconnecting means is a pair of legs telescopically interfitted with one another so as to permit adjustment of the length thereof and thereby of the distance between said rearward mounting means and said forward connecting means.

10. In combination with a hunting scope having an elongated tubular housing with a front end and optical means contained in said tubular housing for producing a first predetermined magnification of an object viewed through said optical means, a magnification lens accessory for enhancing magnification of said hunting scope, comprising:

(a) a magnifying lens adapted to produce a second predetermined magnification of an object viewed through said magnifying lens; and (b) an annular mounting member having a central opening receiving said magnifying lens and an annular skirt extending away from said magnifying lens and removably fitted and mounted over said front end of said tubular housing of said hunting scope such that said second predetermined magnification of said magnifying lens will combine with the first predetermined magnification of said optical means of said hunting scope to thereby increase and enhance the overall magnification of an object viewed through said hunting scope.

11. The accessory of claim 10 wherein said annular mounting member is a housing ring having an annular body defining said central opening through said housing ring and a front annular lip defined on said annular body at a front end of said housing ring and projecting radially inwardly from said annular body.

12. The accessory of claim 11 wherein said magnifying lens is disposed within said opening and adjacent to said front annular lip on said annular body and spaced from a rear end of said housing ring so as to adapt said housing ring at a rear skirt portion to removably fit and mount over said front end of said tubular housing of said hunting scope.

13. The accessory of claim 12 wherein said annular body has an internal annular surface thereon extending from said annular lip to said rear end of said housing ring, said internal annular surface having an internal diameter greater than an internal diameter of said annular lip such that an annular shoulder is formed by a rearward end of said annular lip disposed adjacent to a forward end of said annular surface.

14. The accessory of claim 13 wherein said magnifying lens has opposite front and rear faces and an outer annular edge, said magnifying lens being disposed adjacent to said front annular lip on said annular body with said front face of said magnifying lens in abutting relation with said annular shoulder and said rear face of said magnifying lens spaced from said rear end of said housing ring so as to adapt said housing ring to removably fit and mount over the front end of said tubular housing of said hunting scope.

15. The accessory of claim 14 further comprising:

a mounting bracket having a rearward means for mounting to a portion of said tubular housing of said hunting scope spaced remote from the front end thereof, forward means for connecting with said annular mounting member and elongated means for extending between and interconnecting said rearward mounting means and forward connecting means so as to permit said annular mounting member and said magnifying lens supported therein to be movable toward and away from said front end of said tubular housing of said hunting scope.

16. The accessory of claim 15 wherein said rearward mounting means is a resilient split clamp ring adapted for securely fitting about said portion of said tubular housing of said hunting scope.

17. The accessory of claim 16 wherein said forward connecting means is a pivotal hinge connected between said elongated interconnected means and said annular mounting member.

18. The accessory of claim 17 wherein said elongated interconnecting means is a pair of legs being telescopically interfitted with one another so as to permit adjustment of the length thereof and thereby of the distance between said rearward mounting means and said forward connecting means.

* * * * *